US005267369A

United States Patent [19]

O'Neil et al.

[11] Patent Number: 5,267,369

[45] Date of Patent: Dec. 7, 1993

[54] PAD-TYPE CORNER PAINTING TOOL

[75] Inventors: Robert A. O'Neil, Glen Ellyn, Ill.; Robert A. Chieda, Stratford, Conn.; Leon C. Clouser, Lombard, Ill.

[73] Assignee: EZ Paintr Corporation, Milwaukee, Wis.

[21] Appl. No.: 752,061

[22] Filed: Aug. 29, 1991

[51] Int. Cl.[5] ..... B05C 17/00

[52] U.S. Cl. ..... 15/210.1; 15/244.1; 15/160

[58] Field of Search ..... 15/210 R, 244.1, 210.1, 15/244.2, 235.7, 160, 235.8

[56] References Cited

U.S. PATENT DOCUMENTS

| | | | |
|---|---|---|---|
| 2,678,458 | 5/1954 | Vosbikian et al. | 15/244.2 |
| 3,051,977 | 9/1962 | Pamphilis . | |
| 3,106,736 | 10/1963 | Knapp | 15/244.2 |
| 3,464,079 | 9/1969 | Palmeri . | |
| 3,713,744 | 1/1973 | Sims | 401/9 |
| 3,728,755 | 4/1973 | Whalen | 15/210.1 |
| 4,554,699 | 11/1985 | Simmons | 15/160 |
| 4,631,019 | 12/1986 | House | 15/235.8 |
| 4,674,144 | 6/1987 | Palmeri | 15/210.1 |
| 4,729,143 | 3/1988 | Dawson | 15/210.1 |
| 5,131,111 | 7/1992 | Richardson et al. | 15/244.1 |

FOREIGN PATENT DOCUMENTS

| | | | |
|---|---|---|---|
| 839452 | 6/1960 | United Kingdom | 15/235.7 |

*Primary Examiner*—Harvey C. Hornsby
*Assistant Examiner*—Patrick F. Brinson
*Attorney, Agent, or Firm*—Baker & McKenzie

[57] ABSTRACT

The invention is a pad-type paint or coating applicator whose physical contour may be changed by novel hand pressure applied to applicator during a painting operation. The applicator includes means for changing the cross-sectional contour of the pad over an infinite number of angles by hand pressure applied by the user.

2 Claims, 2 Drawing Sheets

PAD-TYPE CORNER PAINTING TOOL

This invention relates generally to paint applicators and specifically to a paint pad which can apply paint to flat surfaces and, also, inside and outside corners by altering the shape of the pad during use by novel hand applied pressure.

BACKGROUND OF THE INVENTION

Paint pads are becoming increasingly popular for applying paint due to a number of factors, including the evenness with which a layer of paint or other coating can be applied on flat surfaces. Such pads can also bring paint very close to an interior corner formed by two meeting surfaces or planes, but, to date, a good system for applying a very even coating to such interior junctions or corners has not appeared on the market in a paint pad which can paint flat surfaces and such interior corners with equal ease. Likewise, a paint pad which can paint exterior corners and flat surfaces with equal facility has not been known.

A number of proposals have been made for paint pads which address these tasks but none can be described as having achieved general acceptance in the sense that the same pad may be used during one painting job for painting flat surfaces, interior corners and exterior corners. Attempts by prior art workers to achieve one or more of these painting conditions are illustrated in U.S. Pat. Nos. 3,464,079, 3,713,744, 3,728,755, 3,051,977 and 4,674,144. Of the products illustrated in said patents, the '079 and '144 patents show pads useful only for painting exterior corners, and the '744 and '755 and '977 patents disclose applicators which are incapable of painting exterior corners. Of particular significance is that none of the devices of the above prior art are capable of reorientation during use in the sense of adaptation to a different painting condition from paint loading to paint loading without breaking the rhythm of the paint applicator user. Further, none of the known prior devices are applicable to surface junctions having angles greater or lesser than a right angle, as well as right angle junctions.

Thus there exists a need for a pad-type universal paint applicator which can apply paint or other coating to flat surfaces, interior corners and exterior corners with equal facility by using only hand applied pressure exerted on the paint applicator during the painting operation so that the painting rhythm of the user is uninterrupted.

SUMMARY OF THE INVENTION

The invention is a pad-type paint or coating applicator whose physical contour may be changed by novel hand pressure applied to the applicator during a painting operation so that such diverse painting environments as an interior corner, a flat surface, an exterior corner, and all angular relationships therebetween, can be efficiently painted in successive paint applications (if need be) without breaking the painting rhythm of the user. The applicator of this invention is easy to load with paint, particularly as contrasted to the fixed angle configurations of prior devices. Further, the pad-type applicator of this invention does not require special fixturing to shape or glue pre-cut pad elements to conform to any fixed profile. In addition, the present applicator includes an easily reproducible pad element which results in better user value and convenience.

In summary, the paint applicator of the present invention provides a neat, low cost, easy to use pad-type paint applicator which is universally adaptable during use to paint contours which range from 90° interior corners to 90° exterior corners, and even somewhat beyond those limits, as well as all angles in between.

The pad-type universal paint applicator of this invention is essentially a tool consisting of a pad assembly composed of a flexible foam element having fibers bonded on its working surface and a unique backing on its opposed surface, the backing having a hinge which extends its length and thereby enables the backing to flex from one extreme angle of use to an opposite extreme angle of use. The pad assembly may be made by designing the hinge area of the backing with a living hinge or a mechanical hinge. The preferred embodiment uses a bi-component plastic extrusion wherein the hinge area is made with a softer, more flexible material than the parts of the backing which flank it, thus forming a living hinge. Tabs, preferably projecting from the outer side edges of the stiff backing, attach the pad in a loose, "floating", yet secure relationship to a one piece handle. The handle in turn has a hinge area extending its length which is similar to the hinge area of the pad assembly, the two hinge areas being essentially parallel and in alignment but vertically offset from each other. By exerting hand applied pressure to the handle the hinge area of the pad assembly can be caused to move in a "closing" direction which will cause the pad assembly to form an angle of less than 180° whereby the contour of the pad assembly takes a shape which enables the pad assembly to conform exactly to the angular contour of a corner junction having an included angle of less than 180°, such as but not limited to an interior right angle. The exact angle required is achieved by varying the degree of squeeze pressure exerted on the sides of the handle. No significant level of skill is required to attain the exact angle. Most users will instinctively conform the handle to the proper angle at the first use. The pad assembly can be caused to conform exactly to a corner junction having an included angle of more than 180°, such as but not limited to an exterior right angle, by merely pressing the pad loaded with paint against the exterior corner.

BRIEF DESCRIPTION OF THE DRAWING

The invention is illustrated more or less diagrammatically in the accompanying drawing wherein.

DESCRIPTION OF SPECIFIC EMBODIMENT

Figure 1:
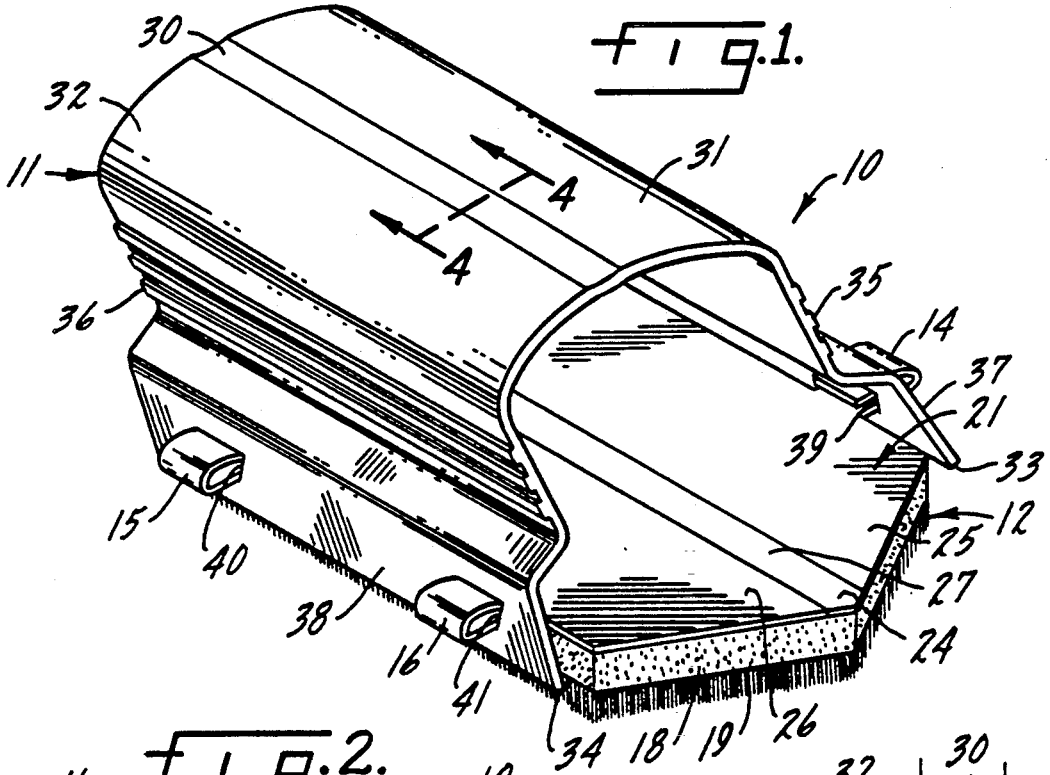
FIG. 1 is a perspective view of the improved pad-type painting tool of this invention in a condition suitable for painting a flat surface.

Like reference numerals will be used to refer to like parts from Figure to Figure in the drawing during the following description of a specific embodiment of the invention.

The improved pad-type painting tool of this invention is indicated generally at 10 in FIG. 1. It includes a handle, indicated generally at 11, and a pad assembly, indicated generally at 12. The pad assembly is mechanically connected to the handle 11 by means of tabs, indicated generally at 13, 14, 15 and 16, which will be described in detail hereinafter.

Figure 5:
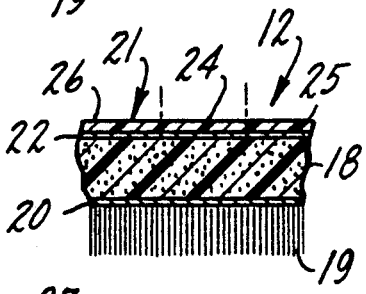
FIG. 5 is a section to an enlarged scale taken substantially along the line 5—5 of FIG. 3.
Figure 3:
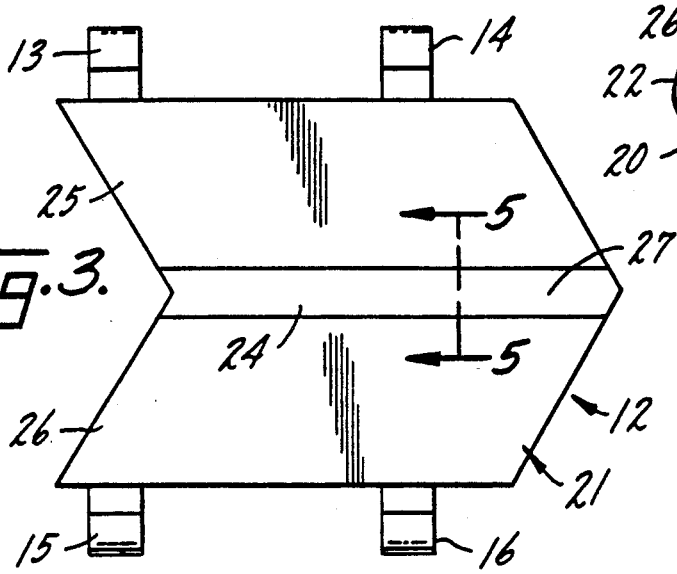
FIG. 3 is a top plan view of the pad assembly of the pad-type painting tool.

Referring now to FIGS. 1–5, and initially primarily to FIG. 5, pad assembly 12 includes a flexible foam element 18. Fibers 19 are bonded to the lower major surface of foam element 18 by any suitable means such as adhesive 20. A backing, which is stiffer than the foam element 18, is indicated generally at 21. The backing 21 is bonded to the foam element 18 by any suitable means such as adhesive 22.

The backing 21 includes a central hinge area, indicated at 24, extending along its length. A pair of stiffer side members which extend outwardly from the longitudinal edge of hinge area 24 are indicated at 25, 26. The hinge 24 may be made by using the well known plastic "living hinge", or it may be a mechanical hinge. The preferred embodiment of the backing 21 is a bi-component plastic extrusion wherein the hinge area 24 is made with a softer material than the side members 25, 26. A pressure area on the hinge near its front end is indicated at 27 in FIG. 1 for a purpose which will appear hereinafter.

Figure 2:
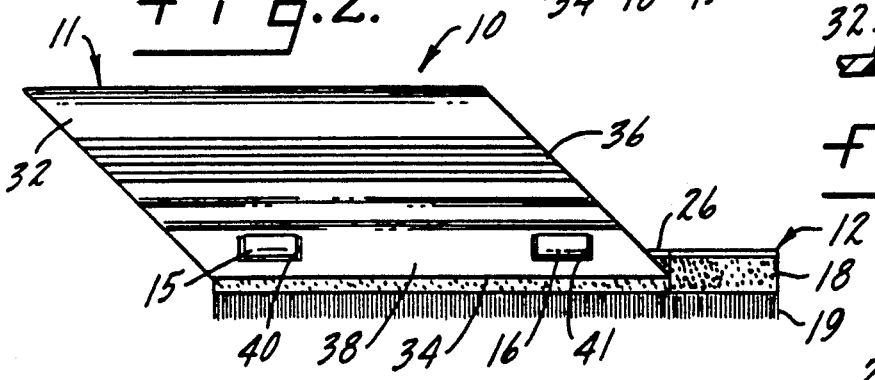
FIG. 2 is a side view of the improved pad-type painting tool of FIG. 1.
Figure 4:
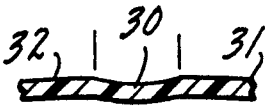
FIG. 4 is a section to an enlarged scale taken substantially along the line 4—4 of FIG. 1.

The handle 11 also has a central hinge area 30 extending along its length which is made similar to hinge area 24. Left and right handle side members 31, 32 extend outwardly from hinge 30 and terminate at bottom edges 33, 34 which, as best seen in FIG. 2, are spaced well above the bottom ends of fibers 19 in an unflexed condition of the tool. Textured or ribbed areas 35, 36 are formed on the exterior sides of the left and right sides 31, 32 of the handle to provide a gripping surface for the user's fingers. The lower most skirt portions 37, 38 of the handle side members are apertured as at 39, 40 and 41 to receive tabs 14, 15 and 16 which project outwardly from the side members 25, 26 of the pad assembly. The tabs are, in effect, merely continuous strips which extend outwardly from the stiff side members 25, 26 and are bent backwardly so that they need be compressed slightly to be received in the apertures 39–41 and the left rear aperture, not shown.

In operation the fibers 19 of the pad assembly 12 are loaded by gently floating the pad assembly 12 on the surface of paint in a container such as a tray of sufficient area and then wiping off excess paint on the tray edges. In the loading mode the pad assembly 12 is substantially flat, as shown in FIGS. 1 and 2, to permit easy, efficient paint loading.

Figure 6:
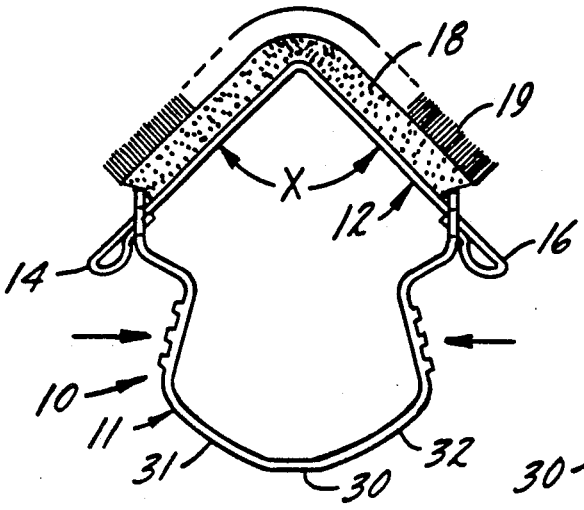
FIG. 6 is an end view of the pad-type painting tool after the handle has been flexed to cause the pad assembly to conform to an interior corner junction.
Figure 7:
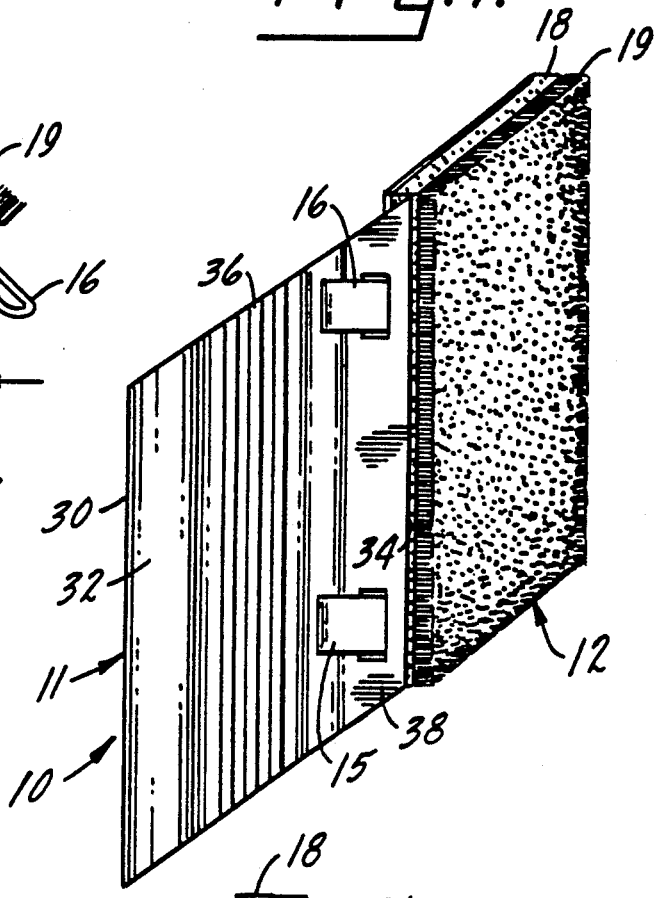
FIG. 7 is a side view of the pad-type painting tool as it appears when operated to paint an interior corner junction as shown in FIG. 6.

To apply paint to an inside, that is, an interior, corner area, handle 11 is grasped by the ribbed areas 35, 36 and squeezed, as shown by the arrows in FIG. 6. Simultaneously the user presses on the pad assembly 12 at pressure area 27, see FIG. 1, or in that general location, to ensure that the pad element bends as shown in FIGS. 6 and 7. At this point, the loaded tool can be used to apply paint into an inside, two plane corner. By squeezing more or less, the pad structure angle X can be varied to fit the specific corner to be painted. The paint application is then accomplished by sliding the contacting tool back and forth along the corner junction.

Figure 8:
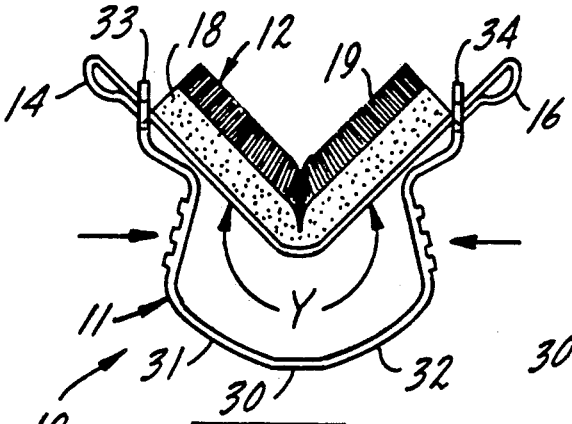
FIG. 8 is an end view of the pad-type painting tool after the handle has been flexed to cause the pad assembly to conform to an exterior corner junction.
Figure 9:
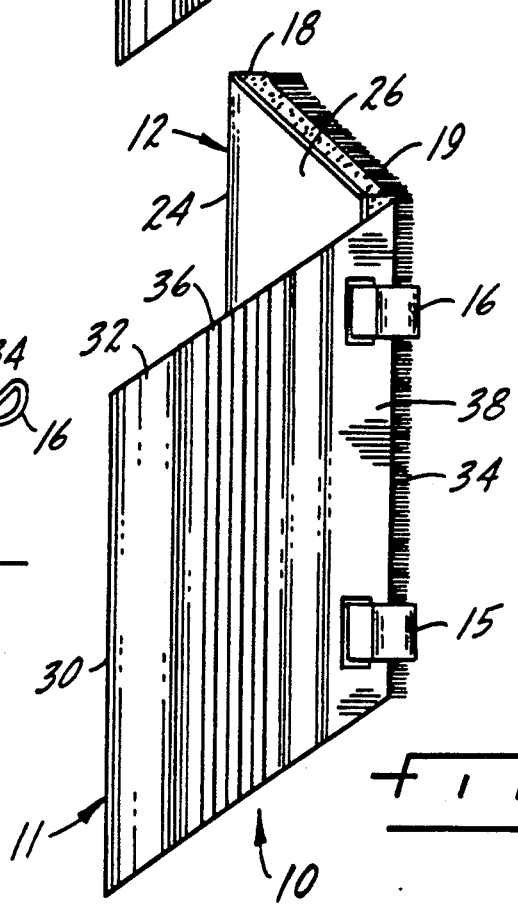
FIG. 9 is a side view of the pad-type painting tool as it appears when operated to paint an exterior corner junction as shown in FIG. 8.

To apply paint to an outside two plane corner area, that is an exterior corner, the center of the pad assembly 12 which has been loaded with paint, is pressed against the outside corner and the handle 11 is squeezed, as shown schematically in FIG. 8 by the arrows. By squeezing more or less, the pad structure angle Y can be varied to fit the specific exterior corner to be painted. Again, paint application is accomplished by sliding the contacting tool back and forth along the corner junction with the parts of the tool in the position shown in FIG. 9.

To paint a flat surface, the paint applicator is used in the condition illustrated in FIG. 1 without the application of squeezing pressure on sides 31, 32, or finger pressure in area 27.

As will be appreciated from the foregoing description, the pad-type painting tool of this invention can paint flat surfaces, or interior or exterior corners of any angle, as contrasted to the fixed angle and fixed plane tools of the prior art, and is very easy to load with paint, as contrasted to angular prior art tools which require difficult and messy loading manipulations. The pad-type device of this invention can be produced more efficiently and economically than the devices of the prior art since the flexible foam element of sheet 18 can be glued to the backing 21 in a flat orientation and in long sheets which are subsequently cut to size. Further, conventional pads require special fixturing to shape and glue pre-cut foam elements to conform to a specific degree profile for the tool, such as 90°. The instant invention, by contrast, is more efficient in design in that it utilizes replaceable pad elements; this results in better user value and convenience.

It should be noted that although living hinges 24 and 30 as illustrated are of substantial widths, the width may vary to some extent. If the width is too small, the flexing action may be impeded. If the width is too large, a crease may form within the hinge material which is angled with respect to the center of the pad. Experience has shown that a hinge of about the illustrated size works well though, as mentioned, variation is possible.

Although a specific embodiment of the invention has been illustrated and described, it will at once be apparent to those skilled in the art that modifications may be made without departing from the spirit and scope of the invention. Accordingly it is intended that the scope of the invention be limited solely by the hereafter appended claims, when interpreted in light of the relevant prior art, and not by the foregoing disclosure.

I claim:

1. A two-piece paint pad assembly whose painting surface contour is changeable from concave to flat to convex and all angles therebetween, and vice versa, by application of the pressure of one hand directly to one of said two pieces, said two-piece paint pad assembly including a one-piece paint pad having a living hinge along the length of its mid-section to enable the paint pad to flex from concave to flat to convex, and all angles therebetween, and vice versa, and a flexible one-piece handle which is hingedly connected to the opposite side edges of the paint pad, said handle being graspable by one hand of a user and being adapted, upon application of squeezing pressure exerted by one hand of the user directly on the handle, to flex the one-piece paint pad so as to cause the paint pad to move from said concave to flat to convex, and vice versa to conform to the surface or surfaces being painted.

2. The two-piece paint pad assembly of claim 1 further characterized in that the paint pad extends forwardly of the handle in all relative positions of the paint pad and the handle a distance sufficient to enable one finger pressure from one hand of the user to be applied directly to the back of the paint pad to push the paint pad away from the handle while the user grasps the paint pad assembly with one hand to thereby cause the paint pad to flex to a convex configuration.

* * * * *